US005177820A

United States Patent [19]

Varallo

[11] Patent Number: 5,177,820

[45] Date of Patent: Jan. 12, 1993

[54] HAIRDRESSING HEAD SUPPORT

[76] Inventor: Isabella Varallo, 1627 S. Franklin St., Philadelphia, Pa. 19148

[21] Appl. No.: 781,834

[22] Filed: Oct. 24, 1991

[51] Int. Cl.[5] ..... A45D 44/10; A45D 19/00

[52] U.S. Cl. ..... 4/523; 4/515; 4/520; 4/522

[58] Field of Search ..... 4/523, 515, 516, 517, 4/519, 520, 522, 575.1; 132/212, 271, 272

[56] References Cited

U.S. PATENT DOCUMENTS 906,410 12/1908 Greene ..... 4/520
2,545,313 3/1951 Sawyer ..... 4/523
3,579,656 5/1971 Guarrasi ..... 4/519
4,998,303 3/1991 Smithers ..... 4/523

*Primary Examiner*—Henry J. Recla
*Assistant Examiner*—David J. Walczak
*Attorney, Agent, or Firm*—Connolly & Hutz

[57] ABSTRACT

A hairdressing head support includes a base or sink mount for mounting the support directly to a hairdresser's sink. A support member is detachably secured to the sink mount with a bender column pivotally connected to the support member for disposing the bender column at various angular orientations. A head rest is connected to the bender column for partially enveloping the head of the user.

10 Claims, 2 Drawing Sheets 16
24
30
66
62
18
22
58
32
48
54
52
40
46
50
56
34
44
36
38
42

HAIRDRESSING HEAD SUPPORT

BACKGROUND OF INVENTION

In hairdressing one of the main considerations is the comfort of the user since various hairdressing procedures, particularly shampooing may require an extended period of time where the user is subjected to a hairdressing procedure. There have, for example, been complaints regarding discomfort during the rinsing of permanent waves because the rods are wrapped too closely around the users neck when placed to rinse the user's hair, thus causing discomfort and even pain. Serious problems may also occur for user's having neck and back medical conditions. Additionally, improper rinsing may result from the closeness of the rods to the wash stand and also because of discomfort to the user. In certain hairdressing procedures it is necessary for the user to hold and raise her head for proper rinsing. For various reasons this sometimes results in the user's clothing becoming wet or even damaged.

U.S. Pat. No. 1,961,244 discloses a headrest for shampoo purposes. In that patent, the headrest consists of members which span across a wash stand with a tubular member mounted at about the central portion of the sink. A U-shaped rod is connected to the tubular member to engage the side of the head so that the head is disposed above the wash stand and water and soap dripping from the top of the head will fall into the wash stand bowl.

U.S. Pat. No. 4,649,580 relates to a neck support for shampoo bowls. In use, the back of the user's neck would be placed in the depression provided in the neck support with the neck support itself being mounted directly to the shampoo bowl so that the user's head is disposed in generally the central area above the bowl.

SUMMARY OF THE INVENTION

An object of this invention is to provide a hairdressing head support which overcomes the problems and fulfills the needs indicated above.

A further object of this invention is to provide such a head support which would be disposed against the back of the user's head for supporting the head above the hairdressing sink.

In accordance with this invention, the hairdressing head support comprises a mount or gripper which is secured directly to the hairdressing sink with a support member extending upwardly from the mount. A bender column is pivotally connected to the support member so that the bender column can be angularly adjusted to different orientations in accordance with the needs of the particular user or hairdressing operation. A head rest is secured to the bender column for partially enveloping the user's head during the hairdressing procedure.

In a preferred practice of the invention a splash shield is mounted to the head rest for protecting the user's clothing and preventing water or other liquids from splashing on the floor. The sink mount may include a padded member which would function as a neck rest when the bender column and support member are removed or would function as a shoulder rest when the bender column and support member are attached.

The head rest is preferably half-moon shaped and provided with drain holes.

THE DRAWINGS

DETAILED DESCRIPTION

Figure 3:
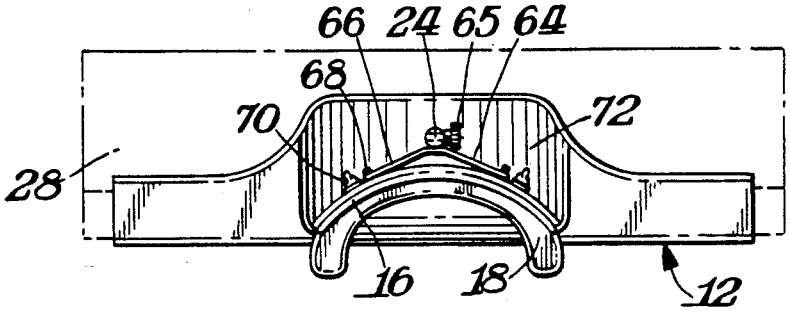
FIG. 3 is a top plan view of the head support shown in FIGS. 1-2.

The present invention is directed to a hairdressing head support 10 which includes as its basic components a gripper or sink mount 12, a bender assembly 14, a head rest 16, a splash shield 18 and a sink mounted rest 20. Rest 20 is preferably part of sink mount 12. The bender assembly consists primarily of a support member or rod 22 and a bender column 24 which are connected together by a pivotal attachment 26 permitting the bender column to move in a vertical plane at various angular orientations toward and away from the center of the sink 28.

Figure 5:
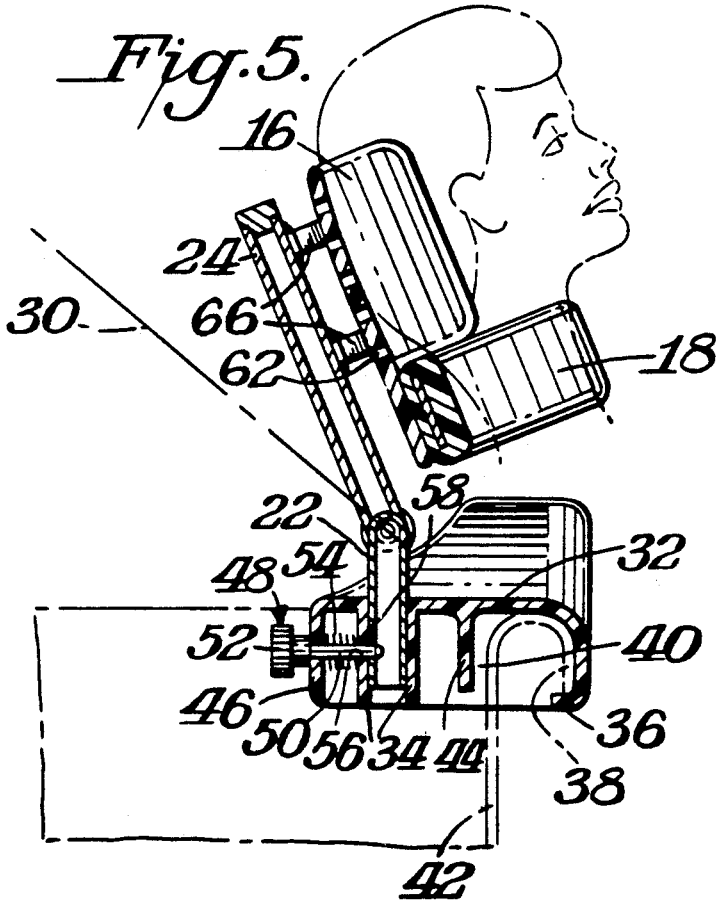
FIG. 5 is a cross-sectional view taken through FIG. 1 along the line 5—5 and showing a user's head.

As best shown in FIG. 5, during use the user's head would be disposed against head rest 16 and could be disposed at any desirable location above the sink 28 in accordance with the particular hairdressing procedure. Thus, for example, the user's head could be disposed at the position shown in FIG. 5 or could be disposed at a lower position indicated by the line 30 of FIG. 5 or to intermediate positions. Similarly, if desired, the user's head could be completely vertical or bender column 24 could be moved forwardly of the vertical position.

Figure 2:
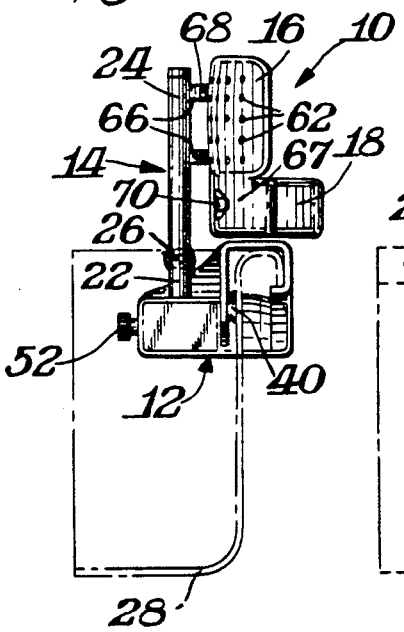
FIG. 2 is a side elevational view of the head support shown in FIG. 1.

FIGS. 2 and 5 best illustrate the details of sink mount 12. As shown therein, sink mount 12 includes a unitary structure comprising a horizontal surface 32 having a series of downward extensions. Surface 32 may be padded and include a concave central section to function as rest 20. One extension is formed by a circular wall 34 into which the bender support rod 22 is inserted. Another extension terminates in an inwardly directed lip 36 which is disposed below the vertical wall 38 of the sink 28 for preventing accidental dislodgement of sink mount 12. A series of suction cups 40 are provided along the length of sink mount 12 for attachment at spaced locations to the inner surface of sink wall 42. Suction cups 40 are connected to downward extension 44 and provide an effective mounting even to a wet surface. Mount 12 is preferably made of a stiff bendable material such as sheet metal so that it could conform to different shaped sinks.

A final downward wall 46 of mount 12 is used for supporting locking member 48 which secures support rod 22 to mount 12. For example, locking member 48 may be in the form of a pin or rod like member 50 terminating in a knob 52 mounted outwardly of wall 46. A spring 54 urges pin 50 toward pocket 34. Pocket 34 includes an opening 56 into which pin 50 slides. Rod 22 would have a corresponding indent or opening 58 so that when the opening 58 of rod 22 is aligned with the opening 56 of pocket 34 pin 50 slides into both openings to securely mount support rod 22 in place. When it is desired to remove support rod knob 52 is pulled outwardly to move pin 50 out of opening 58 so that the bender assembly may be readily detachably mounted on the sink. If desired, rod 22 may include a series of openings 58 so as to provide a vertical adjustability of bender assembly 14.

Figure 1:
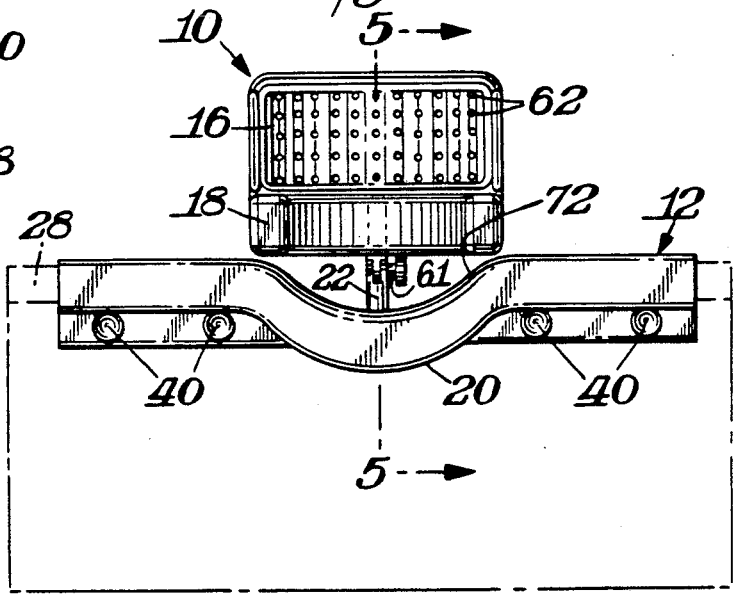
FIG. 1 is a front elevational view of a hairdressing head support in accordance with this invention.
Figure 4:
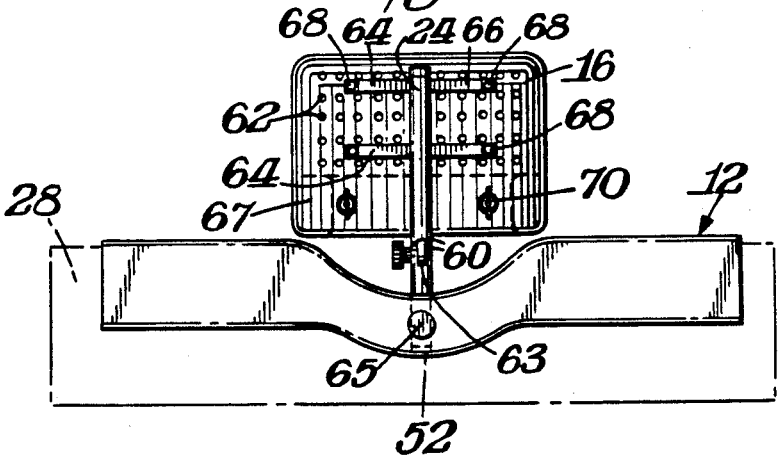
FIG. 4 is a rear elevational view of the head support shown in FIGS. 1-3.

Support rod 22 is connected to bender column 24 by any suitable pivot 26 which would permit bender column 24 to rotate in a vertical plane closer to or further from the center of sink 28. FIGS. 1 and 4, for example, illustrate support rod 22 to terminate in a bifurcation or a pair of legs 60. Bender column 24 in turn terminates in a tongue or single leg 63 disposed between legs 60. A knob 65 has a boss 61 with a threaded extension which extends through aligned holes in legs 60, 60 and extension 63. If desired, the mating places of tongue 63 and legs 60, 60 may include interlocking structure such as ridges and grooves which would maintain column 24 in a particular angular position when the interlocking structures are pressed into contact with each other. When the extension of the boss 61 is threaded and when knob 65 is rotated a tightening would result from the threaded engagement with the threaded openings in column 24 and support rod 22. It is to be understood that any other form of adjustable locking may be used for pivot 26.

Although in the preferred practice of this invention bender assembly includes pivot means which permit the bender column 24 to rotate to various positions in a vertical plane it is to be understood that the invention may also be practiced by using a universal joint to connect bender column 24 to support rod 22. The use of such a universal joint would thereby permit movement of bender column 24, not only in a vertical plane but also in virtually in any direction should there be a need to position the user's head at any specific location beyond a normal straight vertical plane.

As illustrated headrest 16 is in the shape of a half moon in that it is arcuate and would be disposed in back of the user's head generally from ear to ear. Headrest 16 is preferably made of a rigid material such as a hard plastic similar to a dryer hood. As shown in FIGS. 1, 4 and 5 a plurality of drain holes 62 are disposed throughout headrest 16 for complete saturation and penetration onto the scalp and for perm rods. The invention differs from conventional arrangements in that with conventional arrangements the user's neck and head rest on the sink itself. With support 10 however, the user's head would rest on the half-moon shaped head rest 16.

Head rest 16 is secured to bender column 24 in any suitable manner. In the illustrated form two sets of attaching assemblies are used. Each attaching assembly includes arms 64, 66 permanently secured to bender column 24 and disposed against the rear surface of head rest 16. Any suitable detachable fasteners 68 are used to detachably mount head rests 16 to the arms 64, 66. Thus, should it ever be desired to detach head rest 16, such as for repair purposes or to mount a different size head rest in accordance with a particular user, such detachment is readily facilitated. Because of the use of connecting arms 64, 66 it is also possible to space head rests 16 from bender columns 24 so that the bender column is not disposed directly against the head rests and thus would not interfere with the drainage through holes 62.

A further feature of this invention is the provision of splash shield 18. As illustrated splash shield 18 is disposed adjacent to the lower edge of head rest 16. Splash shield 18 extends co-arcuately with the half moon shape of head rest 16 along the entire length of head rest 16 and beyond head rest 16 in the forward direction. The location of splash shield 18 is such as to prevent splashing from a head resting procedure thereby protecting the user's clothing as well as minimizing the likelihood that the floor may otherwise become wet from undesired splashing which could lead to injury to the user or hairdresser.

Splash shield 18 may form an integral extension from head rest 16. Alternatively, splash shield 18 could be detachably secured to head rest 16 by having the shield itself secured by fasteners 70 to an extension of the back plate 67 of head rest 16. Accordingly, it would be possible to replace the splash shield 18 itself without having to replace the entire head rest should a different size or shape splash shield be desired.

A further feature of this invention is the formation of a padded support 20 as part of the sink mount 12. Padded support 20 as illustrated in FIGS. 1 and 4 would be disposed across the front of the sink and would include a concave area 72. During use of head rest 16 the user's shoulders would be disposed against padded support 72. When head rest 16 and bender assembly 14, however, are completely detached, then padded support 72 could function as a neck support in a conventional manner similar to the user of the neck support in U.S. Pat. No. 4,649,580.

As previously indicated, it is possible to provide some vertical adjustability of bender assembly by the selective positioning of support rod 22 in pocket or sleeve 34. Another manner of providing vertical adjustability would be to make bender column 24, of two piece structure formed by a pair of telescopic tubes which can be adjustably secured together in any suitable manner so as to thereby control the overall length of bender assembly 14.

Device 10 may be formed of any suitable materials and in any suitable dimensions. For example, pad 20 may have an overall length of 22 inches to 24 inches. Head rest 16 may have a thickness of about one-half inch and preferably has rounded edges so that no sharp edge is presented to the user. Support shield 18 may be made of a solid material or may be of sheet like form. Head rest 16 may be made of a hard rubber of plastic material. Shield 18 may also be used as a neck support and in which case the splash shield would be padded as would support 20 similar to the padding used in conventional shampoo chairs where the padded material is also waterproof. Preferably, however, shield 18 is simply plastic side extensions from the lower edge of head rest 16.

As can be appreciated, head rest and head support 10 is particularly designed to maximize the user's comfort and stylist posture. Additionally, mount 12 is structured in a manner to fit any standard professional sink and take the shape of the sink. The mount itself includes structure for adhering on a wet surface. The bender assembly is mounted for movement to any desired position forward, backward, straight and vertically. Advantageously, once in the desired position, the bender assembly securely locks in place for the user's safety. The bender assembly can also be easily removed by sliding the assembly away from base or mount 12 and can be again attached by sliding the assembly back into the mount and pushed until it locks by means of spring pin 50.

The heat rest properly supports the client's head in the desired position with respect to the sink and the drain holes permit complete saturation and penetration onto the scalp and perm rods. By use of support 10 the user's head and neck do not rest on the sink, but rather on the half-moon shaped head rest 16. The splash shield 18 provides protection of the user's clothing and protection of the salon by avoiding damaged clothing and wet floors.

Support 10 would also tend to eliminate wasted time in a salon and eliminate the overusage of towels during, for example, a permanent wave or other procedure. Support 10 is particularly beneficial to users having a back or neck injury. When desired, by removing bender assembly 14 the base or mount itself can be used on its own as a padding for the sink.

Among the advantages of support 10 is its ability to take the shape and size of a standard professional sink. This is accomplished by the mount or base 12 fitting as a grip onto the sink and by the bendability of mount 12. Bender assembly 14 could be made similar to a reclining chair so that, for example, it can be moved back to a middle position or a forward position and then locked into place.

Hairdressing support 10 thereby provides the benefits of user comfort, salon protection, and user protection as well as permitting proper rinsing, stylist posture, being able to be moved from sink to sink, eliminate wasted time for rinsing, and eliminate overusage of towels. Moreover, the base or gripper could be used on its own by taking advantage of its padding for shampooing or other surfaces.

What is claimed is:

1. A hairdressing head support comprising a base for detachable mounting to a sink, a bender assembly secured to said base, said. bender assembly including a support rod mounted to said base, a bender column, pivot means connecting said bender column to said support rod whereby said bender column may be adjusted to various angular orientations, a concave head rest secured to said bender column for partially enveloping the user's head whereby the back of the user's head may be disposed against and be supported by said head rest, and a plurality of drain holes extending through said head rest.

2. The support of claim 1 including a splash shield extending below said head rest and extending forwardly of said head rest.

3. The support of claim 2 wherein said bender assembly is detachably mounted to said base, and said base includes a padded neck rest for supporting the user's neck when said bender assembly and head rest are detached therefrom.

4. The support of claim 3 wherein said base includes mounting means capable of mounting said base to a wet surface, and said mounting means including suction cups for engagement with the sink and further including an interned lip for being disposed below the lower surface of the sink.

5. The support of claim 3 wherein said bender assembly is vertically adjustable.

6. The support of claim 3 wherein said head rest is half moon shaped and adapted to extend from ear to ear of the user.

7. The support of claim 3 wherein said splash shield comprises an integral extension of said head rest.

8. The support of claim 3 wherein said splash shield is detachably secured to said head rest.

9. The support of claim 3 wherein said head rest is detachably secured to and spaced from said bender assembly.

10. The support of claim 3 wherein said head rest is made from a rigid material and said neck rest on said base being made of a padded material.

* * * * *